United States Patent [19]

Nowobilski et al.

[11] Patent Number: 4,718,239

[45] Date of Patent: Jan. 12, 1988

[54] CRYOGENIC STORAGE VESSEL

[75] Inventors: Jeffert J. Nowobilski, Orchard Park; Richard C. Cipolla, Williamsville, both of N.Y.

[73] Assignee: Union Carbide Corporation, Danbury, Conn.

[21] Appl. No.: 22,072

[22] Filed: Mar. 5, 1987

[51] Int. Cl.[4] ..... F17C 7/02

[52] U.S. Cl. ..... 62/55; 62/45; 62/50

[58] Field of Search ..... 62/45, 50, 55

[56] References Cited

U.S. PATENT DOCUMENTS

| | | | |
|---|---|---|---|
| 2,609,668 | 9/1952 | Dalton | 62/55 |
| 2,610,471 | 9/1952 | Thayer | 62/55 |
| 2,707,377 | 5/1955 | Morrison | 62/1 |
| 2,863,297 | 12/1958 | Johnston | 62/45 |
| 2,871,669 | 2/1959 | Mann et al. | 62/54 |
| 3,001,375 | 9/1961 | Tauscher | 62/52 |
| 3,234,746 | 2/1966 | Cope | 62/55 |
| 3,491,542 | 1/1970 | Higgs et al. | 62/55 |
| 3,698,200 | 10/1972 | Johnson et al. | 62/45 |
| 3,717,006 | 2/1973 | Kimmel et al. | 62/55 |

*Primary Examiner*—Ronald C. Capossela
*Attorney, Agent, or Firm*—Stanley Ktorides

[57] ABSTRACT

A cryogenic storage vessel and method for a high value cryogenic liquid wherein a second cryogenic liquid is utilized as a refrigerant. The refrigerant cryogenic liquid is caused to pass between a large reservoir and a small accumulator by differential pressure caused by heat leak into the vessel whereby the refrigeration of the cryogenic liquid is more efficiently employed for cooling.

20 Claims, 2 Drawing Figures

CRYOGENIC STORAGE VESSEL

TECHNICAL FIELD

This invention relates to the field of vessels to store and maintain material at cryogenic temperatures wherein cryogenic liquid is used as a refrigerant.

BACKGROUND ART

It is often desired to store or transport material while maintaining the material at a cryogenic temperature. Examples include the storage or transport of liquid helium or liquid hydrogen wherein it is desired to maintain the helium or hydrogen in a liquid state. Generally this has heretofore been accomplished by the use of a lower value cryogenic liquid, e.g., liquid nitrogen, to thermoshield the liquid helium or hydrogen and thermostation storage vessel parts. Typically the conventional arrangement comprises a liquid nitrogen tank at one end of the vessel with the nitrogen passed across the vessel through a large number of lines. As the liquid nitrogen passes across the vessel, heat leak into the vessel causes the liquid nitrogen to vaporize and the nitrogen vapor is vented at the other end of the container. In this way heat is kept from the liquid helium or hydrogen in the center of the storage vessel.

A problem with the conventional vessel is inefficient use of the liquid nitrogen. The liquid nitrogen often undergoes vaporization in an agitated state, i.e., is boiled, and this boiling causes liquid nitrogen, in the form of mist or slugs, to pass through the lines without being vaporized. This liquid eventually passes out of the container without a thermoshielding or thermostationing effect.

It is desirable to have a cryogenic storage vessel which can employ cryogenic liquid for thermoshielding and thermostationing purposes wherein all of the liquid refrigerant contributes to the maintenance of cryogenic temperatures.

It is an object of this invention to provide a cryogenic storage vessel and method wherein a cryogenic liquid may be more efficiently employed for thermoshielding and thermostationing purposes.

SUMMARY OF THE INVENTION

The above and other objects which will become apparent to one skilled in the art upon a reading of this disclosure are attained by the present invention one aspect of which is:

A storage vessel comprising:

(a) a large cryogenic liquid reservoir at one end of the vessel, a small cryogenic liquid accumulator at another end of the vessel, and means to pass cryogenic liquid between the reservoir and the accumulator;

(b) means to maintain the pressure within the reservoir greater than ambient pressure;

(c) a vent valve on the accumulator; and (d) means to operate the vent valve, said means actuated by action of hydrostatic pressure within the accumulator.

Another aspect of this invention is:

A method for maintaining a storage vessel at a low temperature comprising:

(a) maintaining a large cryogenic liquid reservoir at a given pressure which exceeds ambient pressure;

(b) passing cryogenic liquid from the large cryogenic liquid reservoir to a small cryogenic liquid accumulator which is at ambient pressure through a vent valve;

(c) closing the vent valve when the liquid within the accumulator has reached a predetermined amount;

(d) increasing the pressure within the accumulator to exceed the pressure within the cryogenic reservoir and causing cryogenic liquid to pass back into the reservoir; and (e) opening the vent valve when substantially all of the cryogenic liquid within the accumulator has passed into the reservoir.

DETAILED DESCRIPTION

The invention will be described in detail with reference to the Drawings.

Figure 1:
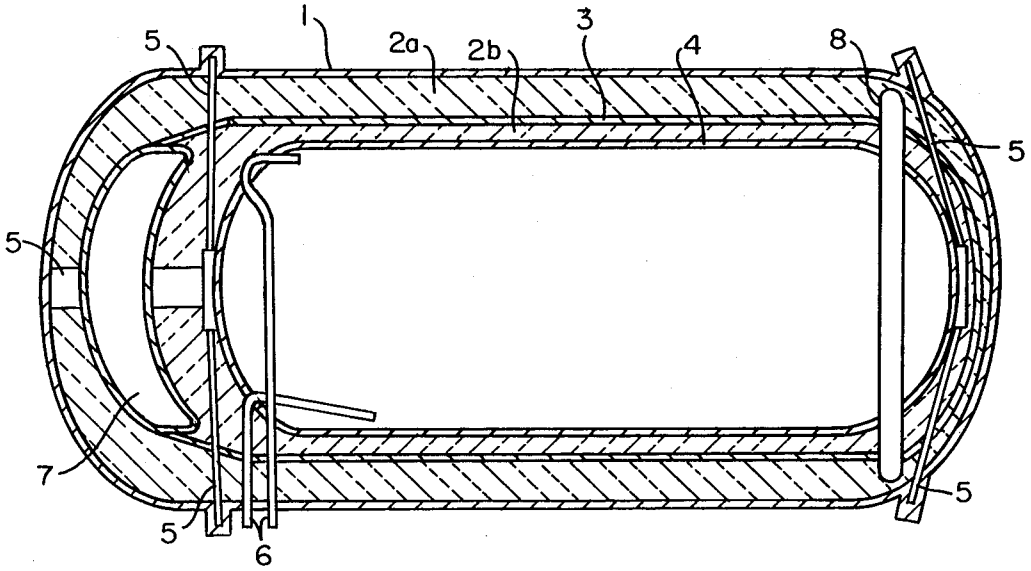
FIG. 1 is a cross-sectional view of one preferred embodiment of the cryogenic storage vessel of this invention.

Referring now to FIG. 1, cryogenic storage vessel 20 is comprised of outer container 1 and inner container 4 which contains material, such as liquid helium, which one intends to maintain at cryogenic temperature. The volume between outer container 1 and inner container 4 preferably is evacuated and contains insulation. A preferred insulation is superinsulation which is well known to those skilled in this art. In the embodiment of FIG. 1 the insulation is in two layers labelled **2*a* and 2*b* divided by thermoshield 3 which is cooled by liquid cryogen such as liquid nitrogen. Thermoshield 3 is preferably made of copper or aluminum. The inner container 4 is supported within outer container 1 by supports 5 and is filled and emptied by means of piping 6. At one end of storage vessel 20 is large cryogenic liquid reservoir 7 and at the other end is small accumulator tank 8. The volume of accumulator 8 is generally within the range of from 1 to 10 percent of the volume of liquid reservoir 7**.

Figure 2:
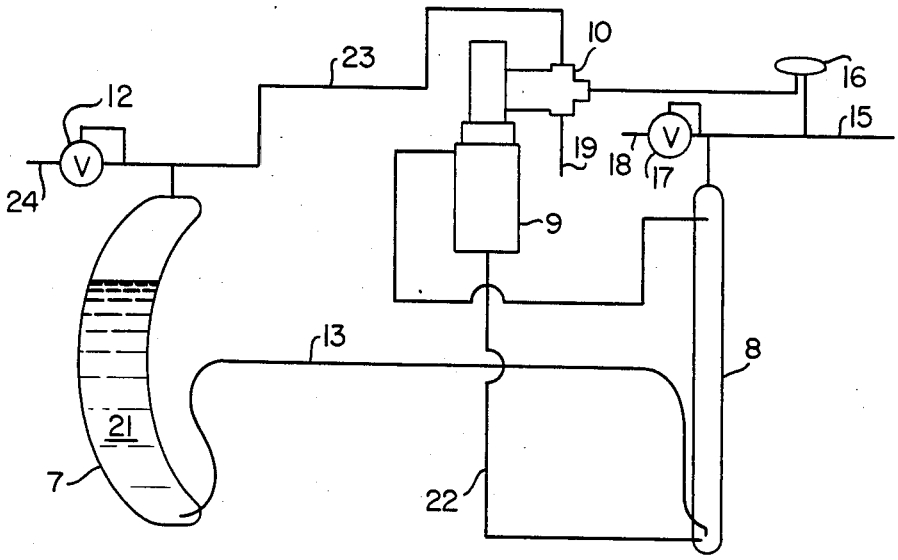
FIG. 2 is a schematic view of the fluid flow control system of the vessel illustrated in FIG. 1.

Referring now to FIG. 2, reservoir 7 is connected to accumulator 8 by means of refrigeration tubing 13 which is in flow communication with the bottom of reservoir 7 and which leads to all items which require thermal stationing such as the shield. Tubing 13 is also in flow communication with the bottom of accumulator 8. Preferably tubing 13 comprises two lines which run on either side of the storage vessel. The pressure within reservoir 7 is maintained above ambient pressure by means of back pressure control valve 12. As used herein the term "ambient" refers to conditions outside the storage vessel; generally such conditions are atmospheric conditions, i.e., atmospheric pressure and temperature. Pressure control valve 12 also serves to maintain valve 16 open by causing pressurized vapor to flow through line 23 to valve 16. Valve 16 is an ambient vent valve on accumulator 8 and, serves, when open, to keep accumulator 8 vented to ambient pressure. By "on the accumulator" is is meant physically on the accumulator or, as in FIG. 2, on a line in flow communication with the accumulator.

In operation cryogenic liquid 21, such as liquid nitrogen, within reservoir 7 is at greater than ambient pressure. The pressure within reservoir 7 is greater than 1 psig and generally is at about 5 psig. The pressure within reservoir 7 is prevented from increasing past the set point by venting excess vapor through vent 24. Vent valve 16 is open and thus the pressure within accumulator 8 is ambient pressure. The pressure difference between reservoir 7 and accumulator 8 causes liquid 21 to pass through tubing 13 wherein it is vaporized as it serves to thermostation container parts. Vaporized nitrogen and nitrogen which remains in a liquid state pass into accumulator 8 and the vapor is vented out of accumulator 8 through valve 16 and vent 15.

Over time liquid accumulates in accumulator 8 and the hydrostatic pressure of such accumulated liquid actuates means which operate vent valve 16. FIG. 2 illustrates a preferred embodiment of such means which comprises double acting, spring loaded piston 9 and pilot valve 10. As liquid accumulates in accumulator 8, pressure developed by the hydrostatic head of the accumulated liquid is applied through line 22 to piston 9. When the liquid within the accumulator has reached a predetermined amount, spring loaded piston 9 is pushed up and causes pilot valve 10 to shift, thus causing pressurized vapor, applied through line 23 to vent valve 16, to be cut off from valve 16 and pass out vent 19. Vent valve 16 is a vapor-open valve so that the cut-off of pressurized vapor to valve 16 causes valve 16 to close. This causes the pressure within accumulator 8 to increase due to heat leak into the vessel. The pressure within accumulator 8 is caused to rise to a predetermined level, greater than that of reservoir 7, be means of back pressure control 17. The accumulator pressure is kept at this level by the venting of excess vapor through vent 18. When the pressure within accumulator 8 exceeds the pressure within reservoir 7, liquid within accumulator 8 is caused to pass back through line 13 into reservoir 7. The position of the piston moves in proportion to the liquid level in the accumulator. The set points are adjusted on the shaft attached to the piston. The trips on the shaft actuate the pilot valve. When substantially all of the liquid within accumulator 8 has passed out, spring-loaded piston 9 is released and causes pilot valve 10 to shift thus allowing vapor to open vent valve 16. This applies ambient pressure to accumulator 8 and the cycle begins anew.

The accumulator enables the collection and reuse of all liquid which passes through the refrigeration line without vaporizing so that the refrigeration in the liquid is not lost. Preferably the accumulator is a long cylindrical container, e.g. a pipe, having a diameter within the range of from 2 to 6 inches. Typically the liquid reservoir has a volume within the range of from 100 to 500 gallons while the accumulator has a volume within the range of from 3 to 30 gallons.

Another advantage of the vessel of this invention is that all refrigeration fluid flow is caused by pressure changes generated by heat leak. A separate power source such as electricity is not needed thus the storage vessel of this invention is well suited for transport of cryogenic contents.

Yet another advantage of the vessel of this invention is the simplified flow of liquid through the refrigeration. There is no need to meter the flow through a number of lines as in conventional systems. This serves to ensure that cryogenic liquid is passed to all parts of the container which require shielding.

Although the storage vessel and refrigeration method of this invention have been described in detail with reference to a specific embodiment, those skilled in the art will recognize that there are other embodiments of this invention within the spirit and scope of the claims.

What is claimed is:

1. A storage vessel comprising:

(a) a large cryogenic liquid reservoir at one end of the vessel, a small cryogenic liquid accumulator at another end of the storage vessel, and means to pass cryogenic liquid between the reservoir and the accumulator;

(b) means to maintain the pressure within the reservoir greater than ambient pressure;

(c) a vent valve on the accumulator; and (d) means to operate the vent valve, said means actuated by action of hydrostatic pressure within the accumulator.

2. The storage vessel of claim 1 wherein the accumulator has a volume of from 1 to 10 percent of the volume of the liquid reservoir.

3. The storage vessel of claim 1 wherein the means to maintain the pressure within the reservoir is by a back pressure control valve set at a pressure which exceeds ambient pressure.

4. The storage vessel of claim 3 wherein the control valve is set at a pressure greater than 1 psig.

5. The storage vessel of claim 1 wherein pressurized vapor from the reservoir serves to maintain the vent valve open by means of a line passing from the reservoir to the vent valve.

6. The storage vessel of claim 1 wherein the means to operate the vent valve comprises a double-acting, spring loaded piston in pressure communication with the accumulator, and a pilot valve shiftable by the double-acting piston, said pilot valve being within a line passing fluid to the vent valve.

7. The storage vessel of claim 6 wherein said fluid is pressurized vapor from the reservoir.

8. The storage vessel of claim 1 wherein the means to pass cryogenic liquid comprises two refrigeration lines having a single point of communication with the reservoir.

9. The storage vessel of claim 8 wherein the refrigeration lines communicate with the reservoir proximate the bottom of the reservoir.

10. The vessel of claim 1 wherein the accumulator is a long and thin cylindrical tank.

11. The vessel of claim 1 further comprising an inner container for the storage of material at a cryogenic temperature, an outer container spaced from the inner container, said space being evacuated and containing insulation, structural supports serving to fix the inner container within the outer container, and empty and fill pipes communicating with the inner container.

12. The vessel of claim 11 wherein the insulation is in two layers divided by a thermoshield.

13. The vessel of claim 12 wherein the thermoshield is cooled by liquid within the means to pass cryogenic liquid between the reservoir and the accumulator.

14. A method for maintaining a storage vessel at a low temperature comprising:

(a) maintaining a large cryogenic liquid reservoir at a given pressure which exceeds ambient pressure;

(b) passing cryogenic liquid from the large cryogenic liquid reservoir to a small cryogenic liquid accumulator which is at ambient pressure through a vent valve;

(c) closing the vent valve when the liquid within the accumulator has reached a predetermined amount;

(d) increasing the pressure within the accumulator to exceed the pressure within the cryogenic reservoir and causing cryogenic liquid to pass back into the reservoir; and (e) opening the vent valve when substantially all of the cryogenic liquid within the accumulator has passed into the reservoir.

15. The method of claim 14 wherein the cryogenic liquid is nitrogen.

16. The method of claim 14 wherein the reservoir is maintained at a pressure which exceeds ambient pressure by greater than 1 psi.

17. The method of claim 14 wherein the vent valve is kept open by flow of pressurized vapor from the reservoir to the vent valve and is closed by the interruption of the flow of said pressurized vapor.

18. The method of claim 17 wherein the flow of the pressurized vapor is maintained or interrupted by the action of a pilot valve which is shifted by a spring-loaded double-acting piston which responds to the hydrostatic pressure of fluid within the accumulator.

19. The method of claim 14 wherein cryogenic liquid serves to maintain helium within the storage vessel in a liquid state.

20. The method of claim 14 wherein the ambient pressure is atmospheric pressure.

* * * * *